United States Patent [19]

Cohn

[11] Patent Number: 4,546,887

[45] Date of Patent: Oct. 15, 1985

[54] SYSTEM FOR SUPPORTING CYLINDRICAL ARTICLES, SUCH AS WINE BOTTLES, IN BULK

[75] Inventor: Robert J. Cohn, Dallas, Pa.

[73] Assignee: InterMetro Industries Corporation, Wilkes-Barre, Pa.

[21] Appl. No.: 522,717

[22] Filed: Aug. 12, 1983

[51] Int. Cl.[4] ..... A47F 7/00

[52] U.S. Cl. ..... 211/49.1; 211/74

[58] Field of Search ..... 211/49 D, 74, 181, 75, 211/76; 108/144; 312/36, 236, 128

[56] References Cited

U.S. PATENT DOCUMENTS

| | | | |
|---|---|---|---|
| D. 96,291 | 7/1935 | Wright | 211/181 X |
| 2,622,741 | 12/1952 | Bamert | 211/74 |
| 3,388,808 | 6/1968 | Radek | 211/181 X |
| 3,680,712 | 8/1972 | Jurasek | 211/181 |
| 3,757,705 | 9/1973 | Maslow | 108/144 |
| 3,804,482 | 4/1974 | Smith | 211/74 X |
| 4,023,681 | 5/1977 | Plant | 211/74 |
| 4,220,245 | 9/1980 | Corcoran | 211/74 X |

*Primary Examiner*—Ramon S. Britts
*Assistant Examiner*—Sarah A. Lechok
*Attorney, Agent, or Firm*—Fitzpatrick, Cella, Harper & Scinto

[57] ABSTRACT

A system for storing cylindrical articles such as wine bottles, in bulk, comprises a plurality of platforms mounted in spaced, generally mutually parallel horizontal relation and a plurality of spacer walls extending at an oblique angle to and in mutually parallel relation between each two adjacent platforms. Each pair of spacer walls is separated by a distance at least equal to twice the effective diameter of one of the cylindrical articles. Therefore, a first row of at least two of the articles can be supported on each platform between adjacent spacer walls. Additional rows of a number of articles, equal to the number in the first row, can then be supported on an underlying row with a portion of the articles in the additional row supported by and between two underlying articles.

17 Claims, 6 Drawing Figures

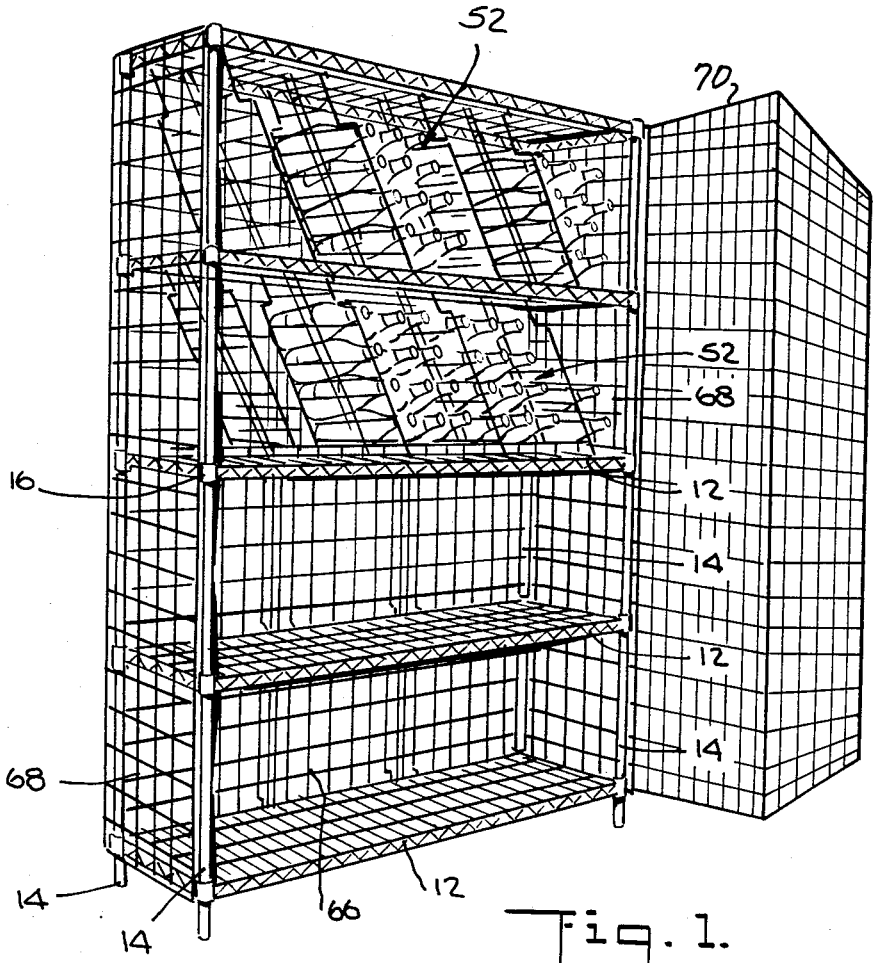
Fig. 1.
Fig. 6.
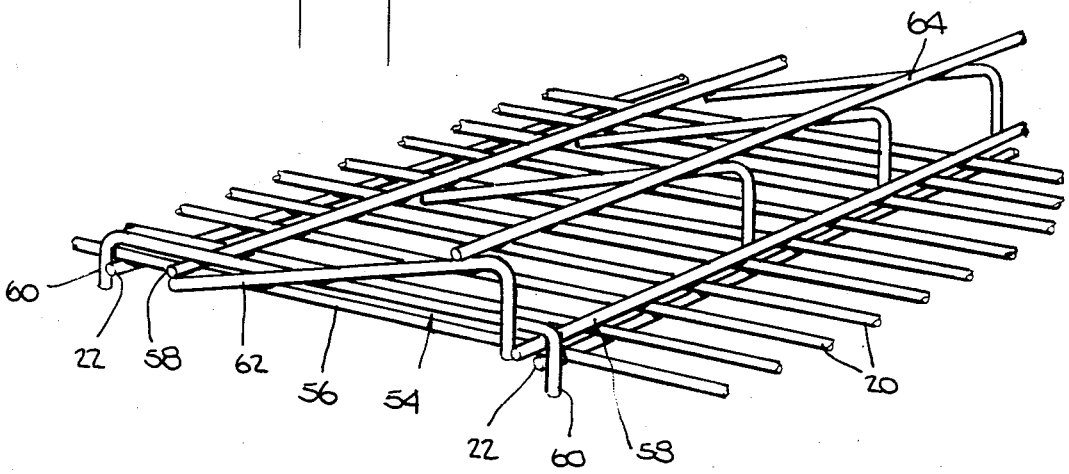

SYSTEM FOR SUPPORTING CYLINDRICAL ARTICLES, SUCH AS WINE BOTTLES, IN BULK

BACKGROUND OF THE INVENTION

1. Field of the Invention

The present invention relates to a system for storing cylindrical articles in bulk. This invention has particular utility as a system for storing bottles, for example, containing wine, in bulk, in a fashion that is attractive, efficient, and facilitates convenient inventory control.

2. Description of the Prior Art

The increased popularity of wine with American consumers has been accompanied by increased need for efficient as well as attractive storage of wine bottles.

In the past, wine bottles have conventionally been stored in bins that are rectangular, diamond-shaped, or triangle-shaped. Typical rectangular storage bins have a base, a roof parallel to the base, and mutually parallel side walls extending perpendicularly between the two to thus define a rectangle in front elevation. The base and roof, and the side walls, are spaced by distances greater that twice the diameter of one wine bottle. Accordingly, bottles maybe stored in rows, the first of which is supported on the base and extends between the side walls and the second and subsequent ones of which are supported on an underlying row. The bottles thus form vertical columns. This rectangular bin arrangement is disadvantageous in that nesting of bottles does not occur in any row that spans the space between adjacent spacer walls. That is, a bottle in such a row is not supported by and in contact with two underlying bottles but rather is supported by a single underlying bottle to thereby form a vertical column. While a rapid inventory may be taken by multiplying the number of bottles in the rows by the numbers of bottles in the columns, the bottles are not densely arranged to make most efficient use of available space. Further, when a first bottle is removed from each row, the remaining bottles will roll toward the V-shaped spaces formed between underlying bottles and undesirable agitation of the sediment in, for example, red wine will occur. Moreover, the possibility of bottle breakage also exists.

It is possible to store bottles in rectangular bins in rows of unequal length but with each bottle supported by and between two underlying bottles in the V-shaped spaced formed between them. However, with this storage configuration it is somewhat difficult to take a rapid inventory since it is not possible to merely count the total number of rows and columns of bottles and multiply the two numbers to produce a total of stored bottles.

Triangular and diamond-shaped bin arrangements include boundary walls having either diamond or triangular shapes in front elevation. Both such configurations permit each bottle in a stored row to be supported by two adjacent bottles in an underlying row. Therefore, bottle storage density is increased. Further, removal of one bottle in a row does not cause movement of other bottles therein, since the other bottles are all stably supported between two adjacent bottles in an underlying row. Thus, certain disadvantages of rectangular bin configurations are overcome. However, these latter types are usually more difficult to construct and are not readily adaptable for adjustment of bin sizes. Of course, since wine bottles come in various sizes, adjustability of the bin dimensions is desirable.

Moreover, since horizontal rows of bottles stored in both triangular and diamond-shaped bins are of unequal length, it is more difficult to take quick inventory of the number stored.

Therefore, known bulk wine storage systems have inherent drawbacks.

SUMMARY OF THE INVENTION

It is a principal object of the present invention to provide a system for storing cylindrical articles, such as bottles of wine, in bulk, that eliminates or mitigates the drawbacks of known bulk storage systems described above.

More particularly, it is an object of the present invention to provide a system for storing cylindrical articles in bulk that makes most efficient use of available volume.

It is a further object of the invention to provide such a system in which each bottle is stored with high stability and independently of adjacent bottles in the same horizontal row. Accordingly, removal of any one bottle in a row does not disturb other bottles, or otherwise cause them to move.

It is still a further object of the present invention to provide a system for storing cylindrical articles such as wine bottles in which an inventory of the number present can quickly and conveniently be taken at a glance.

In accordance with the preferred embodiment, the system of the present invention includes a plurality of base platforms mounted in spaced generally mutually parallel horizontal relation. A plurality of spacer walls extends at an oblique angle to and in mutually parallel relationship between each pair of adjacent platforms. Therefore, the adjacent base platforms and adjacent spacer walls have a rhomboid shape in front elevation.

Each pair of spacer walls is separated by a distance at least equal to twice the effective diameter of one of the articles. Thus, a first row of at least two articles may be supported on each base platform between adjacent spacer walls. Additional rows of a number of articles equal to the number of articles in the first row may then be supported on an underlying row between adjacent spacer walls. Therefore, each bottle in each additional row is supported either on two bottles in the underlying row or on one underlying bottle and one spacer wall.

Consequently, each bottle is held stably by underlying supports independently of adjacent bottles in the same row. Further, because of the rhomboid shape of the storage bin, each full row of bottles has an equal number permitting an inventory of remaining bottles held therein to be rapidly taken at a glance.

The rhomboid shape of each storage bin also permits the bulk storage system of the present invention to be designed for easy modification of bin size.

The objects of the invention briefly described above, along with other objects, aspects, and advantages of the invention will be pointed out in or will be understood from the following detailed description provided below in conjunction with the accompanying drawing.

BRIEF DESCRIPTION OF THE DRAWING

FIG. 1 is a perspective view of the preferred embodiment of the present invention for storing cylindrical articles such as bottles in bulk.

FIG. 6 is a partial perspective view of a stabilizer mounted on one platform.

DETAILED DESCRIPTION OF THE PREFERRED EMBODIMENT

In its preferred embodiment, the system of the present invention for storing cylindrical articles in bulk is of modular construction comprising platforms and spacer walls formed of welded wire and assembled on supporting corner posts. For example, the basic components of the bulk storage system of the present invention, namely the platform and corner posts, may be of the type generally available from Metropolitan Wire Corporation, the assignee of the subject invention, under the trademark SUPER ERECTA SHELF.

Furthermore, in its preferred embodiment, the subject invention is specifically designed to store bottles, such as wine bottles, in bulk. However, it will be readily understood that this system may be used to store other cylindrical articles or generally cylindrical articles in the same fashion.

Referring now to FIG. 1, the system of the present invention is generally indicated at 10 and includes a plurality of generally horizontal platforms 12 which are rectangular in top plan view and are supported at each corner by a vertically extending corner post 14. The corners of each plaform may be equipped with a frustoconical sleeve 16 that cooperates with a two-part frustoconical collar (not shown) to grippingly engage one corner post in a manner shown in U.S. Pat. Nos. 3,757,705 (Maslow) and 3,424,111 (Maslow), and commercially embodied in the SUPER ERECTA SHELF system available from Metropolitan Wire Corporation. Since the details of this system are fully described in the Maslow patents mentioned above and which are incorporated herein by reference, they will not be described further here.

Of course, other structures for securing each platform to vertical supporting columns or posts may be utilized. However, the SUPER ERECTA SHELF system is particularly advantageous in that it permits easy adjustment of the spacing between adjacent platforms and further permits quick assembly and disassembly of the system for shipment, storage, or other movement.

Figure 2:
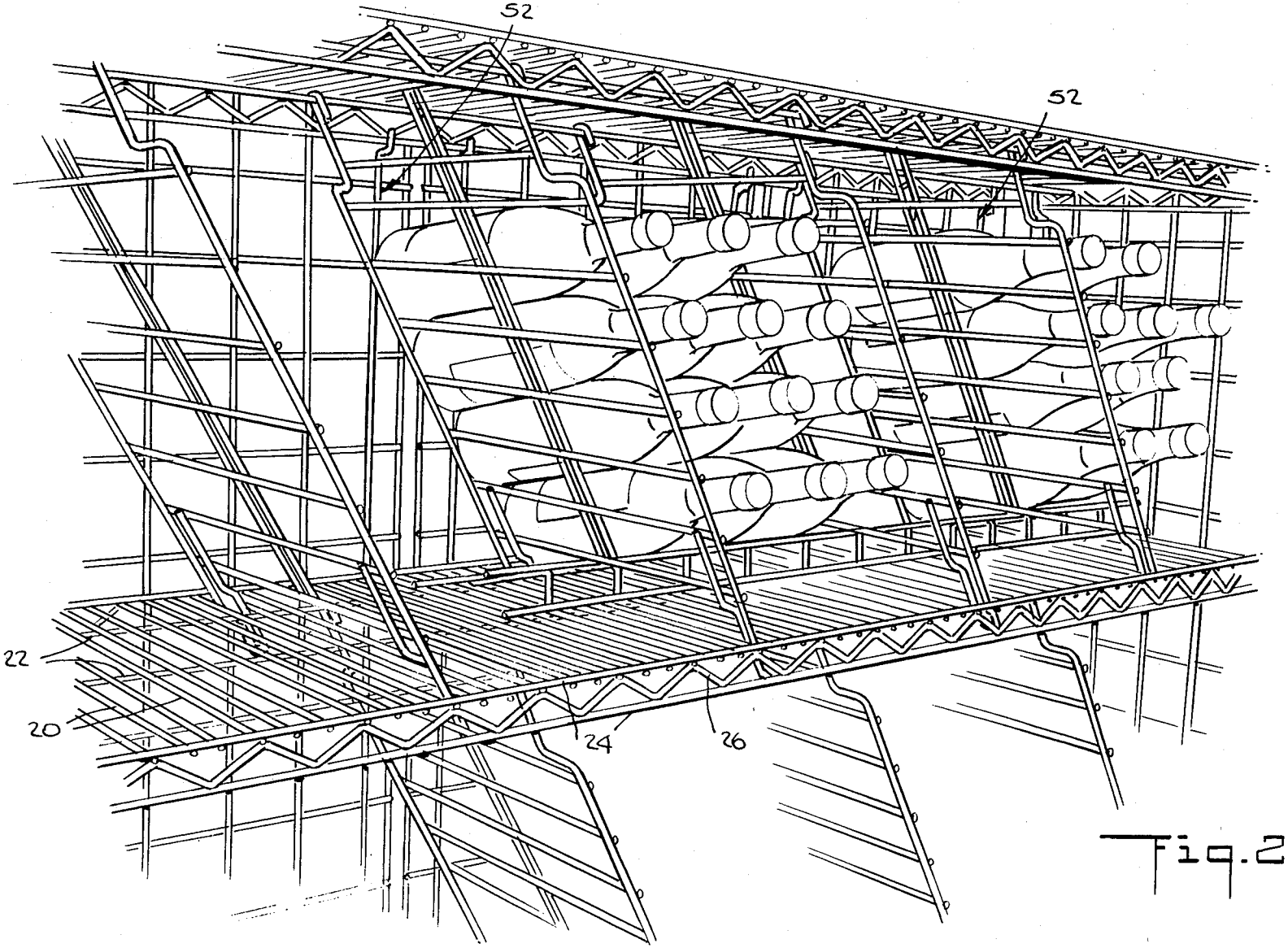
FIG. 2 is an enlarged perspective view of two adjacent platforms assembled with a plurality of spacer walls. A number of bottles are in certain bins defined by the platforms and spacer walls.
Figure 3:
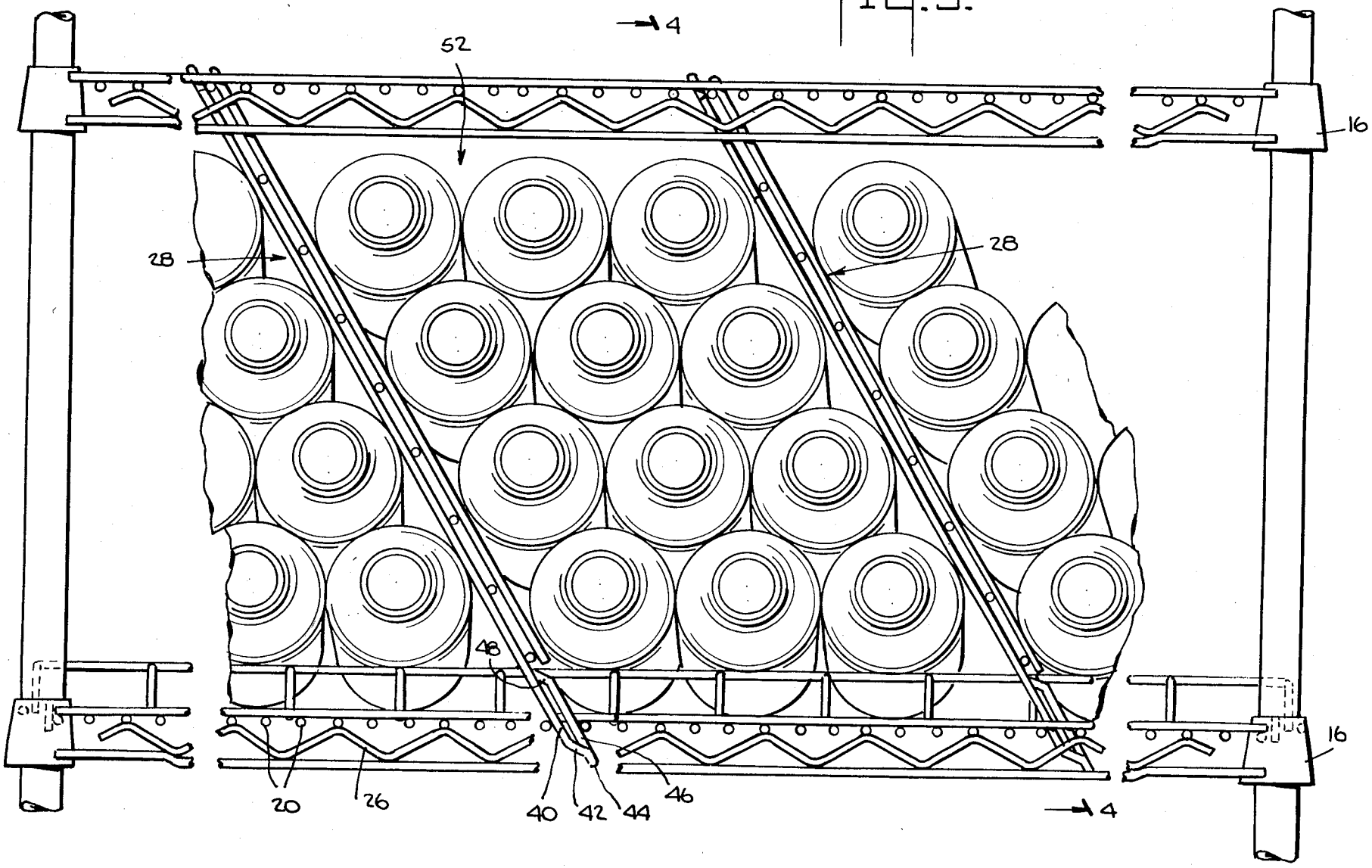
FIG. 3 is a front elevational view of the platforms, spacer walls, and bottles shown in FIG. 2.
Figure 5:
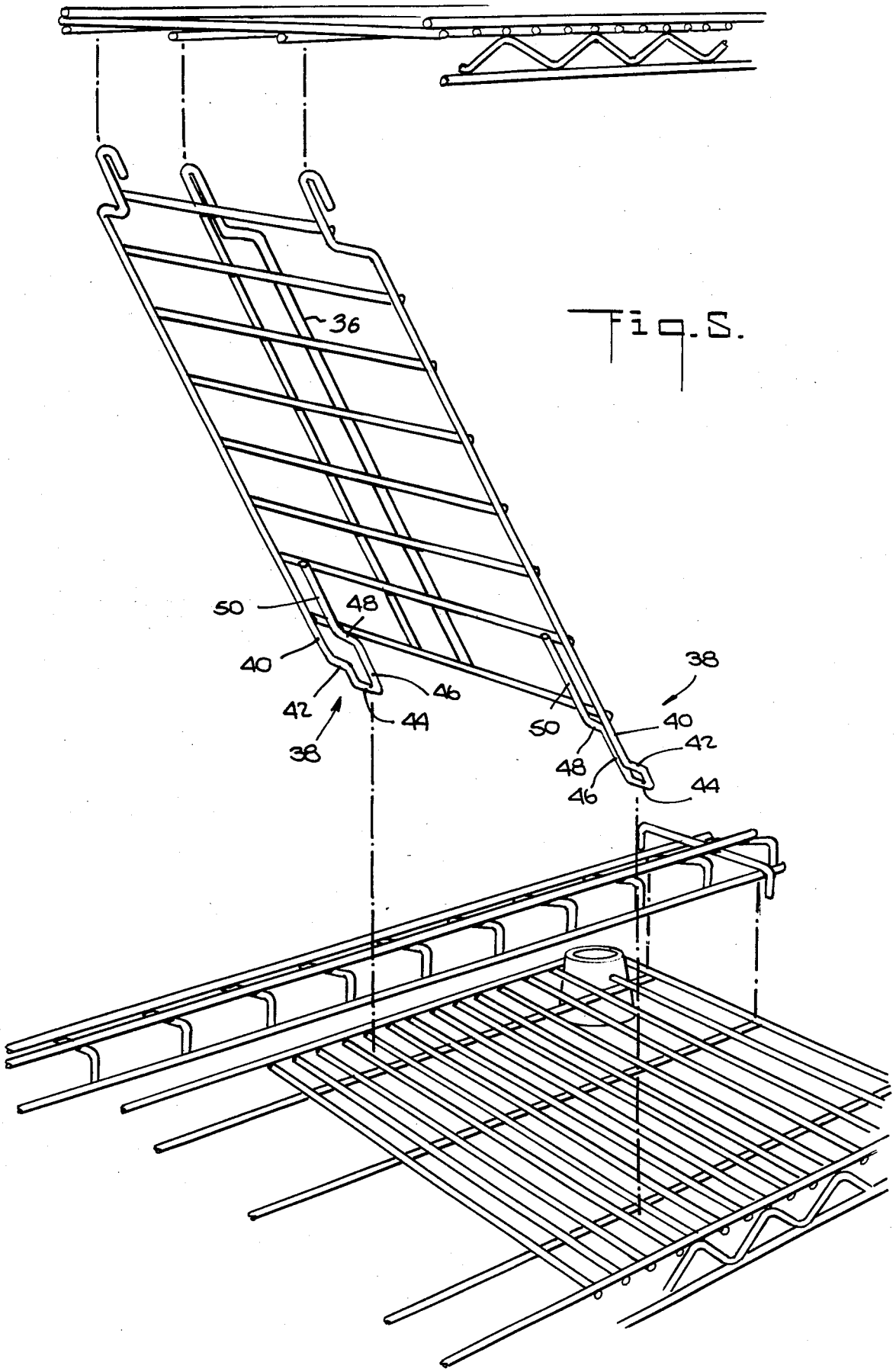
FIG. 5 is an exploded perspective view of two adjacent platforms, a stabilizer mountable on the lower platform, and a spacer wall.

As shown in greater detail in FIGS. 2, 3 and 5, each horizontal platform comprises a plurality of shelf-forming wires 20, extending from the front of the platform to the back, that are welded to the tops of a plurality of underlying support wires 22 that extend from one side of the platform to the other. A pair of spaced mutually parallel boundary wires 24 extend between pair of adjacent sleeves 16 located at each corner of the platform. Each pair of boundary wires defines a generally vertically extending plane.

A serpentine connecting wire 26 undulates between and is welded to the lowermost of each pair of boundary wires and the underside of a number of shelf forming wires 20 to add rigidity to the platform structure.

As shown in FIGS. 1 through 5 the bulk storage system of the present invention further includes a plurality of spacer walls 28 each of which comprises a pair of outer vertical wires 30 that both terminate at an upper extreme in a downwardly opening hook 32. A plurality of horizontally extending, mutually parallel wall-defining wires 34 are welded at each of their ends to the vertical wires 30 and a central closely spaced pair of backup wires 36 extend perpendicularly to the wall-defining wires and are welded thereto, again to provide rigidity to the spacer wall structure and to stabilize the bottles.

The hooks 32 formed at the upper extremes of the vertical wires 30 are spaced apart by a distance aproximately equal to that between two underlying support wires 22 in each platform. These hooks may each engage one of the support wires 22 to suspend the spacer wall from beneath one platform 12 as shown in detail in FIGS. 2, 4, and 5.

Figure 4:
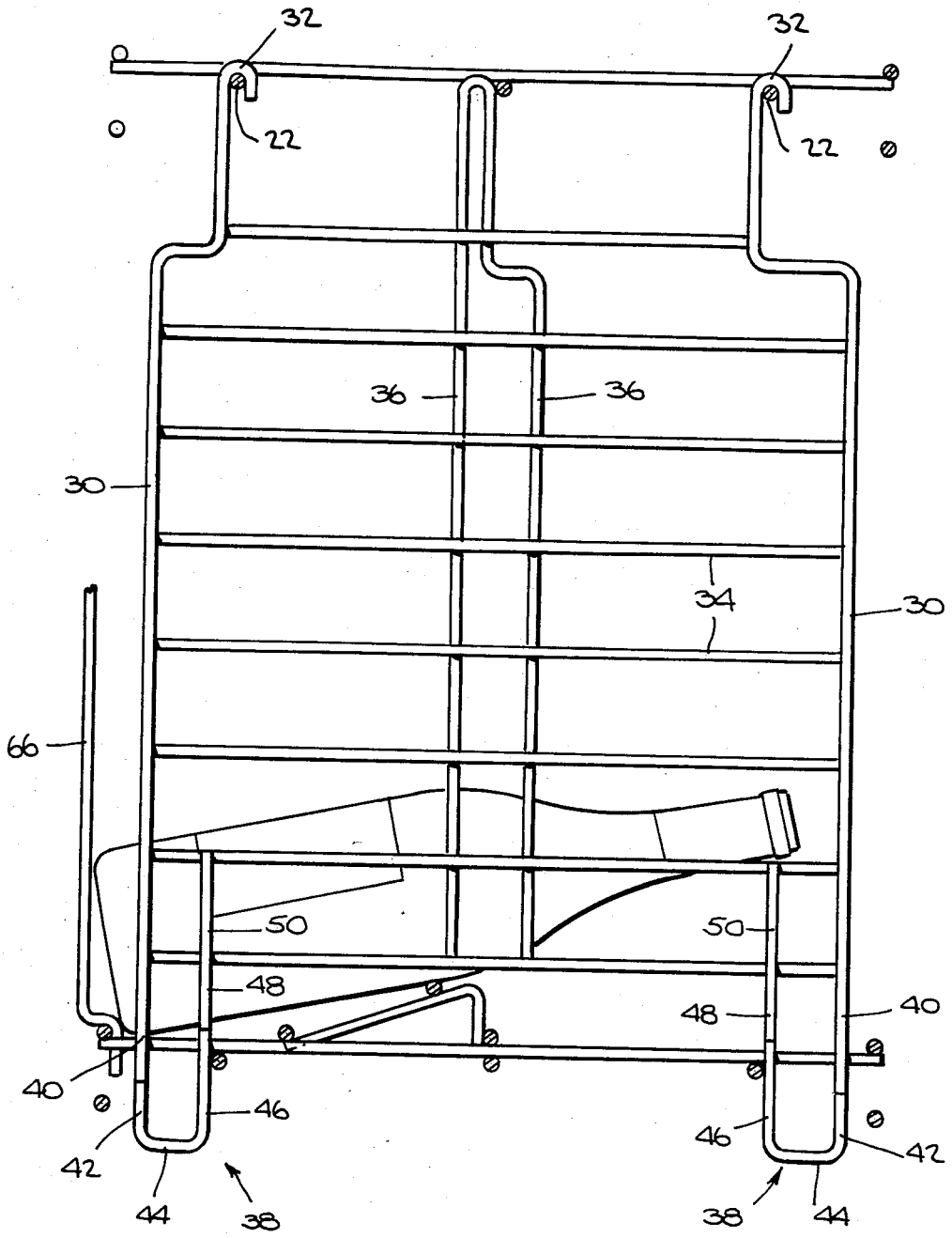
FIG. 4 is a side elevational view, taken on plane 4—4 in FIG. 3, of the one spacer wall and of a stabilizer for elevating one end of bottles in a first row stored in a bin.

At the lower extreme, each vertical wire is formed with a sidewardly enlarged tab structure 38, shown best in FIGS. 3, 4 and 5, that includes a first leg 40 extending continuously from the vertical wire, a second leg 42 extending obliquely and to the side from the first leg 40 (FIGS. 3, 4, and 5) a third leg 44 extending perpendicularly and toward the front or back of the spacer wall structure from the second leg 42 (FIG. 4 and 5), a fourth leg 46 extending perpendicularly and upwardly from the third leg 44 (FIGS. 3, 4 and 5), a fifth leg 48 extending obliquely and to the other side from the fourth 46 (FIGS. 3, 4 and 5), and a sixth leg 50 extending in parallel to the vertical wire 30 and secured to two of the lower wall-defining wires 34. The distance between the first and fourth legs 40 and 46 respectively, in the sideward direction as seen in FIG. 3, is slightly less than the distance between adjacent shelf-forming wires 20 in each support platform 12 for a reason described in greater detail below.

Each spacer wall 28 is assembled with adjacent support platforms 12 by first inserting the hooks 32 formed at the upper extremes of the vertical wires 30 between two support wires and sliding the spacer wall upwardly. The spacer wall 24 is then tilted to define an oblique angle of approximately 60° with the lowermost support platform. The tab structures 38 formed at the lower extremes of the vertical wires 30 are thereafter engaged between two shelf-forming wires 22 of the lowermost of the two support platforms again as depicted in FIG. 5 with the hooks 32 each engaging one support wire. Tilting of the spacer wall locates the tab structures 38 between the adjacent shelf forming wires to firmly secure the spacer wall in place. The assembly configuration is shown clearly in FIGS. 3 and 4. Additional spacer walls are assembled between the two platforms in the same fashion and to extend in parallel with the first spacer wall as assembled. Accordingly, as can be seen in FIGS. 1, 2, and 3, the several spacer walls and support platforms define a number of bins or compartments 42 that are rhomboid-shaped in front elevation.

In order to efficiently utilize the system of the invention, the spacer walls should be spaced by a distance at least equal to twice the diameter of a typical cylindrical article, such as a wine bottle, to be stored in a bin 52 defined thereby. Accordingly, the first row of articles may be stored in the bin defined by adjacent spacer walls and upper and lower support platforms by being placed on the lower support platform. The bottle at one extreme of this first row will lie against the lower platform and one spacer wall extending at an obtuse angle thereto and the bottle at the other extreme of the first row will lie against the platform and a second spacer wall extending at an acute angle thereto and acting as a bottle retainer. Additional rows are then supported on an underlying row with a first bottle in each in contact with and supported by the first bottle in the underlying row and one spacer wall. Additional bottles in each additional row are each supported by two underlying bottles. As can be seen best in FIG. 3, due to the rhomboid shape of each storage bin 52, each row of articles is equal in number to the first row. Therefore, a rapid inventory may be obtained by taking the product of the number of articles in the first row and the number of rows. Further, because of the stable support for each article in every row, undesirable agitation of the articles which might, for example, disturb sediment in red wine or cause breakage of the articles, is virtually eliminated. Thus, it will be appreciated that the bulk storage system of the present invention provides significant improvements over known systems in an elegant and simple fashion.

It will also be readily appreciated that the sizes of bins and the number of bins may be readily modified, merely by adjusting the space between adjacent support platforms and using spacer walls of different lengths, or by adjusting the space between adjacent spacer walls. Therefore, this system may be adapted to store articles of various sizes.

Added stability may be provided for the stored articles by a rail or stabilizer 54, shown best in FIGS. 2 through 6, that comprises a number of inverted U-shaped wire mounting member 56 joined by two sidewardly extending linear connecting wires 58. The depending legs 60 of each mounting member are spaced by a distance slightly larger than that between two sidewardly extending support wires 22 in a support platform 12 in order to embrace these support wires and prevent front to back movement of the stabilizer as shown in FIG. 6.

A number of angle wire elevating members 62 are joined at their lower most extremes to respective ones of the connecting wires 58 and a support wire 64 is joined to the upper surfaces of the elevating members at or near their vertices.

A stabilizer 54 is mounted at the central portion of each horizontal platform 12 by having the depending legs 60 of each of the U-shaped wires 56 straddle two laterally extending support wires 22 thereon. Cylindrical articles supported on the platform will then have a forward end thereof, elevated as shown in FIG. 4. Accordingly, the articles may be stably stored on each horizontal platform.

The bulk storage system of the present invention may also include a rear wire wall 66 secured in suitable fashion to the rear boundaries of each of the platforms 12, or to the rearmost corner posts 14. Similarly, side walls 68 may also be mounted with the bulk storage system, each again being attached to each of the horizontal platforms 12 or the sidemost corner posts. With the rear and side walls in place as shown in FIG. 1, the cylindrical articles are even more stably and securely stored since they are tilted by the stabilizer toward and held against the rear wall as shown in FIG. 4.

Finally, this system of the invention may also include wire door structures 70 (only one of which is shown in FIG. 1) for securely enclosing the interior of all of the bulk storage bins.

Examples of side walls, rear walls, and doors, that may be adapted to the system of the present invention are shown in copending U.S. patent application Ser. No. 406,251, assigned to Metropolitan Wire Corporation.

It will be appreciated that the storage system of the present invention provides a unique and elegant system for storing cylindrical articles in bulk with high stability. Moreover, this system permits an inventory of stored articles to be easily obtained merely at a glance. In addition, bin size can quickly and conveniently be adjusted to accomodate cylindrical articles of various sizes.

Accordingly, although a system for bulk storage of cylindrical articles has been disclosed in detail above, it is to be understood that this is for purposes of illustration. Modification may be made to this bulk storage system in order to adapt it to particular applications.

What is claimed is:

1. A system for supporting generally cylindrical articles, comprising:

platform means;

means for supporting said platform means in generally horizontal relation;

first spacer wall means projecting upwardly from and forming an obtuse angle with said platform means; and retaining means projecting upwardly from said platform means and spaced from said spacer wall means said spacer wall means and the portion of said platform means between said spacer wall means and said retaining means defining said obtuse angle, the distance between said spacer wall means and said retaining means being at least equal to twice the effective diameter of one of the articles;

whereby a first row of at least two articles may be supported on said platform means between said spacer wall means and said retaining means, and additional rows of a number of articles equal to the number of articles in the first row may be supported on an underlying row; a portion of the articles in each additional row each being supported by and between two underlying articles.

2. A system according to claim 1, said retaining means comprising second spacer wall means projecting upwardly from and forming an obtuse angle with said platform means and being in generally mutually parallel relation with said first spacer wall means.

3. A system according to claim 2, further comprising means for securing said first and second spacer wall means together at a location spaced from said platform means.

4. A system according to claim 3, wherein said securing means comprises a second platform means.

5. A system according to claim 1, further comprising rear wall means mounted with said spacer wall means and said platform means and extending generally perpendicularly to the planes defined by both.

6. A system according to claim 1, further comprising means for elevating one end of each article in the first row.

7. A system accordingly to claim 6, wherein said elevating means comprises a rail mounted with and having a portion spaced above said platform means and extending in the direction between said spacer wall means and said retaining means.

8. A system according to claim 1, further comprising rear wall means secured to said spacer wall means and said platform means and extending generally perpendicularly to the planes defined by both; and elevating means mounted with said platform means, extending in the direction between said spacer wall means and said retaining means, and spaced from said rear wall means for elevating one end of each cylindrical article in said first row thereby causing it to be inclined downwardly rearwardly toward said rear wall means.

9. A system for densely storing generally cylindrical articles, such as bottles or the like, in bulk, said system comprising:

a plurality of base platforms;

means for mounting said base platforms in spaced generally mutually parallel horizontal relation; and a plurality of spacer walls extending at an oblique angle to and in mutually parallel relation between each pair of adjacent ones of said platforms, each pair of said spacer walls together with a pair of said platforms thereby defining a rhomboid front elevation and each pair of spacer walls being separated by a distance at least equal to twice the effective diameter of one of the articles;

wherein a first row of at least two articles may be supported on each said platform between adjacent ones of said spacer walls and additional rows of a number of articles equal to the number of articles in the first row may be supported on an underlying row between said adjacent ones of said spacer walls with a portion of the articles in each additional row being supported by and between two underlying articles.

10. A system according to claim 9, wherein each said base platform comprises a shelf including a plurality of parallel support wires, a plurality of shelf-forming wires secured to said support wires, and a peripheral boundary structure to which said support wires and said shelf-forming wires are secured.

11. A system according to claim 10, wherein each said spacer wall comprises a plurality of generally vertically extending parallel wall wires; hook means formed at the upper extreme of at least a portion of said wall wires for engaging at least one of said support wires and said shelf-forming wires of the uppermost of a pair of adjacent platforms; and means for engaging at least one of said support wires and said shelf-forming wires of the lowermost of said pair of adjacent platforms to hold said spacer wall at said oblique angle with respect to both platforms in said pair.

12. A system according to claim 9, further comprising a rear wall mounted with said platforms and said spacer walls and extending generally perpendicularly to the planes defined by both.

13. A system according to claim 9, further comprising two end walls each mounted adjacent one end of said platforms.

14. A system according to claim 9, further comprising a rear wall mounted with said platforms and said spacer walls and extending generally perpendicularly to the planes defined by both, two end walls each mounted adjacent one end of said platforms, and closure wall means for selectvely enclosing said the front of said platforms and said spacer walls opposite said rear wall.

15. A system according to claim 9, further comprising means for elevating one end of each article in the first row.

16. A system according to claim 15, wherein said elevating means comprises a rail mounted with and having a portion spaced above said platform means and extending in the direction between adjacent spacer walls.

17. A system according to claim 9, wherein said oblique angle is about 60°.

* * * * *